US008228357B2

(12) United States Patent
Im et al.

(10) Patent No.: US 8,228,357 B2
(45) Date of Patent: Jul. 24, 2012

(54) GENERATION OF SUBPIXEL VALUES AND LIGHT SOURCE CONTROL VALUES FOR DIGITAL IMAGE PROCESSING

(75) Inventors: Moon-Hwan Im, Cupertino, CA (US); Seok-Jin Han, Cupertino, CA (US); Sarah Sunyoung Hwang, Sunnyvale, CA (US); Bai-Shuh Hsu, Freemont, CA (US)

(73) Assignee: Samsung Electronics Co., Ltd. (KR)

( * ) Notice: Subject to any disclaimer, the term of this patent is extended or adjusted under 35 U.S.C. 154(b) by 412 days.

(21) Appl. No.: 12/511,912

(22) Filed: Jul. 29, 2009
(Under 37 CFR 1.47)

(65) Prior Publication Data

US 2011/0025733 A1 Feb. 3, 2011

(51) Int. Cl.
*G09G 5/02* (2006.01)

(52) U.S. Cl. ..... 345/694; 345/102; 345/613; 382/266

(58) Field of Classification Search ..... 345/89, 345/102, 613, 694; 382/266, 269, 299
See application file for complete search history.

(56) References Cited

U.S. PATENT DOCUMENTS

| | | | | |
|---|---|---|---|---|
| 5,341,153 | A * | 8/1994 | Benzschawel et al. | 345/694 |
| 5,572,236 | A * | 11/1996 | Feig et al. | 345/603 |
| 5,717,474 | A * | 2/1998 | Sarma | 349/85 |
| 6,801,220 | B2 * | 10/2004 | Greier et al. | 345/694 |
| 7,750,887 | B2 * | 7/2010 | Bergquist | 345/102 |
| 2003/0034992 | A1 | 2/2003 | Brown Elliott et al. | |
| 2005/0104908 | A1 | 5/2005 | Brown Elliott | |
| 2005/0225575 | A1 | 10/2005 | Brown Elliott et al. | |
| 2007/0279372 | A1 * | 12/2007 | Brown Elliott et al. | 345/102 |
| 2009/0109248 | A1 * | 4/2009 | Huber et al. | 345/694 |

FOREIGN PATENT DOCUMENTS

WO 2006/127555 11/2006

* cited by examiner

*Primary Examiner* — Kimnhung Nguyen
(74) *Attorney, Agent, or Firm* — Innovation Counsel LLP

(57) ABSTRACT

A display system (110) has a subpixel array (120) and a light source (140). In normal mode, image data (164) are processed by the display system to generate subpixel values (174) for the subpixels (130) and to generate a light source control value (BL) for the light source (140). In bypass mode suitable for testing new types of image-data processing, the subpixel values and the light source control value are generated by an external system (210) and are provided to the display system which is operated in bypass mode. The light source control value is not provided separately from the subpixel values but is encoded into some bits of the subpixel values for compatibility with older interfaces. The light source control value is encoded into the subpixel values' MSBs in case the subpixel values could be truncated. Other features are also provided.

23 Claims, 5 Drawing Sheets

GENERATION OF SUBPIXEL VALUES AND LIGHT SOURCE CONTROL VALUES FOR DIGITAL IMAGE PROCESSING

BACKGROUND OF THE INVENTION

The present invention relates to display of digital images. Some embodiments provide enhanced capabilities for testing new methods of image processing.

FIG. 1 illustrates a conventional display system 110 of the type widely used in computers, telephones, and other kinds of equipment. Display system 110 is based on an LCD (liquid crystal display) technology, and includes a display unit 114 having a subpixel array 120 with subpixels 130. A backlight unit 140 emits light passing through subpixels 130 to a viewer 150. Subpixel control circuit 160 controls the subpixels 130 to transmit more or less light from backlight unit 140 as needed to display a desired image.

The image is defined by digital image data (e.g. RGB data) 164 supplied to image processing circuit 170. Circuit 170 generates subpixel values ("SPXV") 174 from the image data and supplies subpixel values 174 to subpixel control 160. Subpixel values 174 specify the desired state of each subpixel 130. The subpixel states indicate how transmissive the subpixels must be to display the image. Subpixel control 160 generates corresponding voltages to drive the subpixels into the desired states.

The processing performed by image processing circuit 170 depends on the type of subpixel array 120. In a color display, each subpixel 130 displays a primary color. The primary colors can be red, green and blue; or red, green, blue and white; or cyan, magenta and yellow; or some other combination of colors. Image data 164 may define the image as a number of pixels, each pixel's color being defined by color coordinates in some color space (e.g. RGB). The color space may be unrelated to the primary colors of subpixels 130. Image processing circuit 170 generates the subpixel values from the color coordinates. This operation may be complex. For example, image processing circuit 170 may sharpen the image. Also, subpixel layout in array 120 may have a complex relationship to pixel data 164. For example, an input pixel in data 164 can be mapped into an area which lacks some primary color. See e.g. PCT application published as no. WO 2006/127555 A2 on 30 Nov. 2006 incorporated herein by reference, and describing a system which maps some input pixels 164 into pairs of red and green subpixels 130, while mapping other pixels into pairs of blue and white subpixels 130. If a pixel is mapped into a pair of blue and white subpixels 130 but the pixel's color include a non-zero red coordinate, then the corresponding red luminance can be displayed by adjacent red subpixels. Generation of subpixel values 174 can be complex.

New types of image processing are periodically designed to improve image quality, reduce the cost and size of image processing circuit 170, increase the image processing speed, reduce power consumption, and possibly for other reasons. Image processing circuit 170 is typically a hardwired circuit. In order to facilitate testing of new designs, a new design may initially be implemented in software, e.g. using a development system 210 of FIG. 2. System 210 may be a computer having a computer processor 220 executing computer instructions stored in a computer storage 230. Storage 230 can also be used to store suitable data, e.g. RGB data 164 and subpixel values 174. System 210 processes the RGB data 164 and generates subpixel values 174 according to the new design. In order to test the image generated by the new design, the subpixel data 174 are provided to a conventional display system 110 of older design. The image processing circuit 170 is placed in a Bypass mode by an externally supplied bypass signal 240. In this mode, circuit 170 passes the input data to subpixel control 160, and the data get displayed by subpixel array 120.

It may be possible to provide image processing circuits with better capabilities for testing of new designs.

SUMMARY

This section summarizes some features of the present disclosure of invention. Other features may be described in the subsequent sections. The disclosure includes the appended claims, which are incorporated into this section by reference.

Testing of new designs presents a challenge if a design pertains to a display system using content adaptive backlight control (CABC) also known as dynamic backlight control (DBLC). DBLC systems 110 (FIG. 3) dynamically control the output power of backlight unit 140 so as to reduce power consumption and/or increase dynamic contrast range. The dynamic control involves reducing the output power for dark images. The lower output power is compensated by modifying subpixel values 174 to make subpixels 130 more transmissive. In normal (non-bypass) operation, in addition to subpixel values 174, image processing circuit 170 of FIG. 3 generates a signal BL controlling the backlight unit. Although FIG. 3 (and also FIG. 5) uses reference numbers and symbols that are similar to those used in background FIGS. 1-2, this is for sake of convenient one-to-one matching of only the more basic and gross functions performed by the similarly numbered parts and it is not to be viewed as indicating that any same numbered parts in FIGS. 3, 5 are identical to those of background FIGS. 1-2. More specifically and for example, the backlighting unit 140 of background FIG. 2 is not responsive to, and does not receive, a backlighting control signal BL as does the backlighting unit 140 of background FIG. 3, and therefore the two similarly numbered backlighting units are not the same.

In some embodiments of the present invention, in bypass mode, image processing circuit 170 can pass both the BL signal and the subpixel values 174 from development system 210 to display unit 114. In some embodiments, this can be done without changing the physical interface between development system 210 and image processing circuit 170. More particularly, development system 210 encodes the BL signal into the subpixel values 174 so as to only minimally distort the subpixel data. Image processing circuit 170 extracts the BL signal.

The invention is not limited to the features and advantages described above.

DESCRIPTION OF SOME EMBODIMENTS

The embodiments described in this section illustrate but do not limit the invention.

Figure 1:
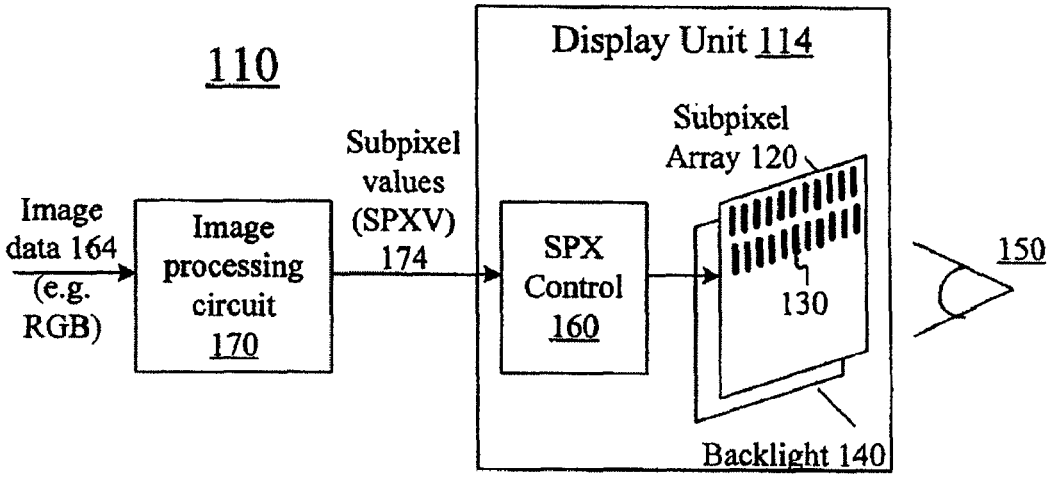
FIG. 1 (PRIOR ART)
FIG. 1 is a block diagram of a display system according to prior art.
Figure 2:
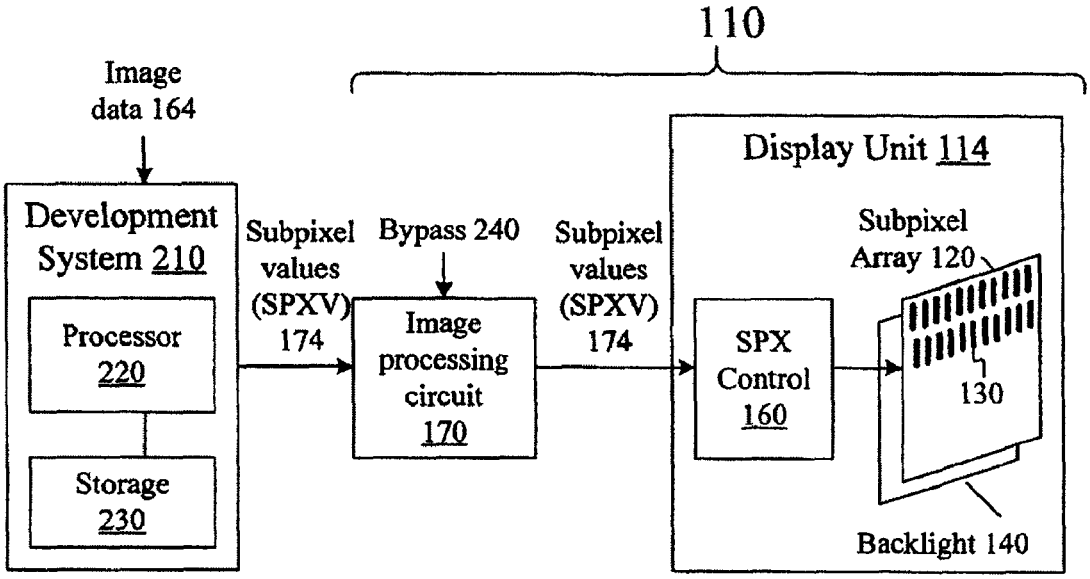
FIG. 2 (PRIOR ART)
FIG. 2 is a block diagram of a display system and a development system according to prior art.
Figure 3:
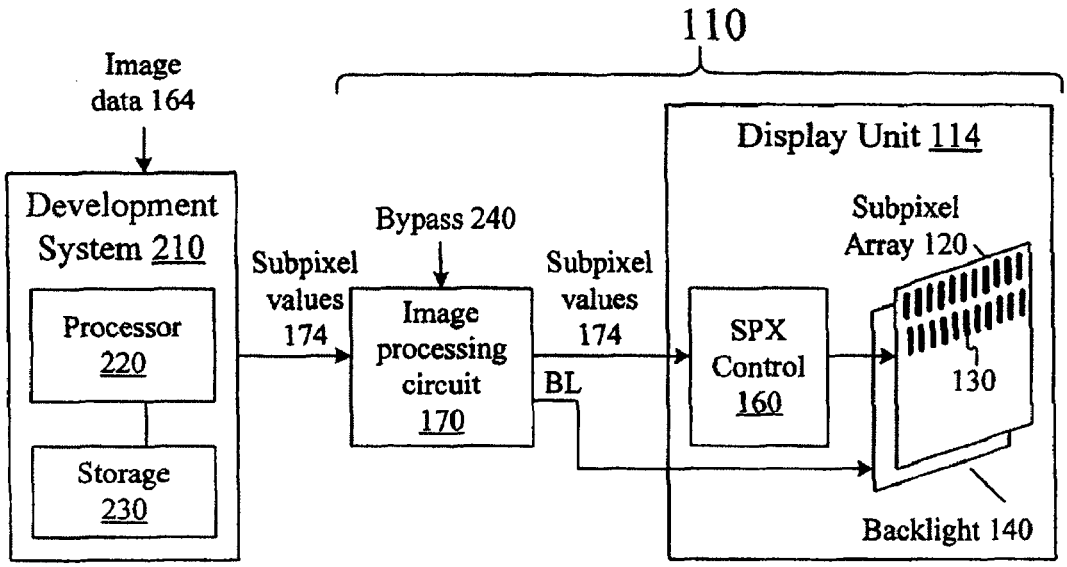
FIG. 3 is a block diagram of a display system and a development system according to some embodiments of the present invention.
Figure 4:
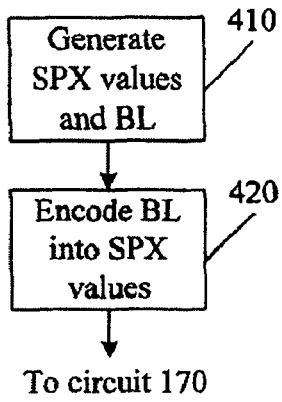
FIG. 4 is a flowchart of operations performed by a development system in some embodiments of the present invention.

FIG. 4 is a flowchart of operations performed by development system 210 of FIG. 3 in some embodiments of the present invention. Development system 210 can be a computer as in FIG. 2, or can be some other type of system. The processing of FIG. 4 can be performed by executing suitable software.

At step 410, development system 210 generates subpixel values 174 and the corresponding signal BL. At step 420, development system 210 encodes the signal BL into subpixel values 174 so as to minimize distortion of the subpixel values. For example, in some embodiments, only the least significant bits (LSB) of subpixel values 174 are affected. Some other encoding techniques are described below in connection with FIG. 6.

The subpixel values 174 with encoded signal BL are then passed to image processing circuit 170 as in FIG. 3 or 2. Thus, the physical interface to circuit 170 does not have to be changed. In particular, in some embodiments, the physical interface has the same data width as in FIG. 2. In some embodiments, the subpixel values 174 have the same number of bits before and after encoding of the BL signal. Exemplary physical interface is shown in a hardware description language Verilog in Table 2 discussed below.

Figure 5:
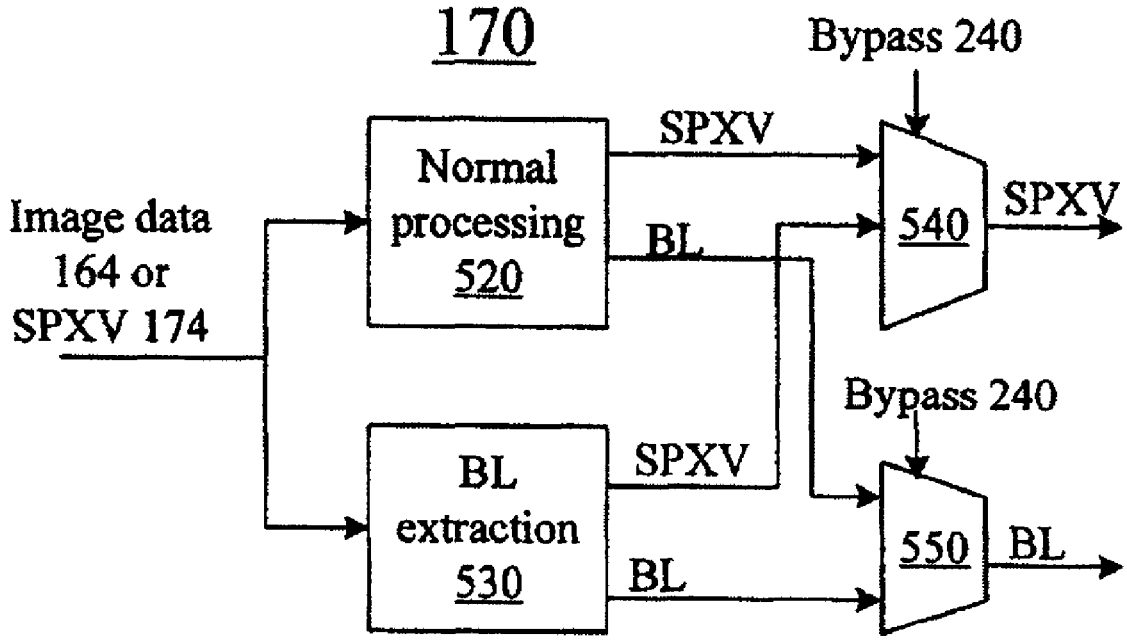
FIG. 5 is a block diagram of an image processing circuit used in some embodiments of the present invention.

FIG. 5 is a block diagram of image processing circuit 170 used in some embodiments of the present invention. The input signal, containing either image data 164 or subpixel values 174, is routed to normal processing circuit 520 and BL extraction circuit 530. Each of circuits 520, 530 generates the subpixel values SPXV and the backlight unit control signal BL. Circuit 520 performs normal mode operation. Circuit 530 extracts the signal BL from the subpixel values in bypass mode.

The subpixel values SPXV from each of circuits 520, 530 are provided to respective inputs of multiplexer 540. The BL signal from each of circuits 520, 530 is provided to respective inputs of multiplexer 550. The select inputs of the two multiplexers receive the bypass signal 240. If bypass signal 240 specifies normal mode, then multiplexers 540, 550 select respectively the SPXV signal and the BL signal from normal processing circuit 520. If bypass signal 240 specifies bypass mode, then multiplexers 540, 550 select respectively the SPXV signal and the BL signal from BL extraction circuit 530. The selected SPXV signal is provided to SPX control 160 (FIG. 3). The selected BL signal is provided to backlight unit 140.

Other types of circuitry can also be used. For example, the multiplexers 540, 550 can be omitted. Bypass signal 240 can be used to disable circuit 520 in bypass mode, and to disable circuit 530 in normal mode. The invention is not limited to specific circuitry.

Figure 6:
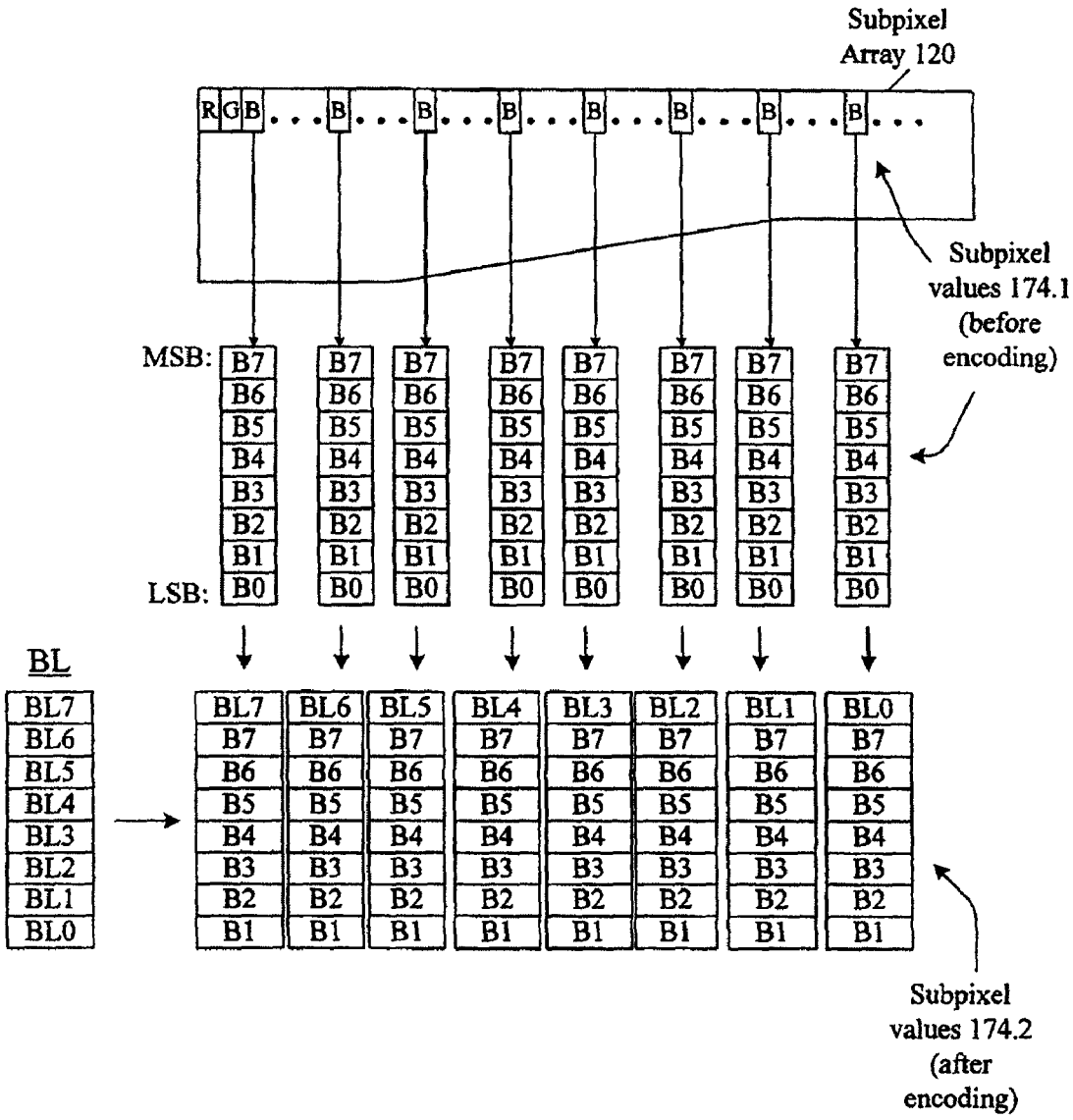
FIG. 6 illustrates data transformations performed by a development system according to some embodiments of the present invention.

FIG. 6 illustrates data values in some embodiments of step 420 of FIG. 4. Table 1 below illustrates a computer program, written in LUA programming language, implementing one embodiment of step 420. In these embodiments, the signal BL is encoded to minimize image distortion by taking into account that human vision is not equally sensitive to all colors. It is assumed that the primary colors of subpixels 130 include red, green, blue, and possibly others. Of the red, green and blue, human vision is less sensitive to distortion in blue. Therefore, the BL signal is encoded to distort only the blue subpixels' values. Moreover, these subpixel values correspond to subpixels 130 at an edge of subpixel array 120 to minimize any artifacts.

In FIG. 6, the subpixel values before encoding are shown at 174.1. At the top of the figure, the subpixel values are shown superimposed over subpixel array 120. It is assumed for the sake of example that the BL signal is eight bits wide. This assumption is not limiting. The subpixel values of the first eight blue subpixels, at the top left corner of the subpixel array, are chosen. Each subpixel value is shown to consist of bits B7-B0, with B7 being the most significant bit (MSB).

Only the least significant bits (LSB) of the subpixel values 174.1 are compromised. However, the BL value BL7-BL0 is encoded into the most significant bit (MSB) positions of the subpixel values, not the least significant bit positions (LSB). The original subpixel values B7-B1 are shifted to the LSB positions 6-0. This is done because some circuits 170 truncate the subpixel values. Use of the MSB positions saves the BL signal from truncation. Further, truncation would affect only the LSBs of the subpixel values.

In Table 1, in line En5, the variables b, g, r store the currently-processed red, green and blue subpixel values at step 420. Each of these values is assumed to be 8 bit wide. The name "spr.band" denotes bitwise AND operation. The name "spr.bor" denotes bitwise OR. The input value LED is the BL value BL7-BL0. The variable "mask" is the bit index in the BL value (i.e. mask selects one of BL7-BL0). Each iteration of the loop in lines En5-En9 processes one of the first eight blue-subpixel values, writing into the most significant bit position the BL bit indicated by "mask".

TABLE 1

ENCODING

```
En1:   function PWMhide(buf,LED) --hide the LED PWM value
       in an image
En2:     local mask=128
En3:     local x
En4:     for x=0, 7 do
En5:           local b,g,r = spr.fetch(buf,x,0)     -- fetch the first 8 pixels
En6:           b = spr.band(b/2,127)                  --hack out the upper bit
En7:           if spr.band(mask,LED) ~= 0 then
En8:                 b = spr.bor(b,128)          --put the PWM bit in there
En9:           end
En10:          mask = mask/2
En11:          spr.store(buf,x,0,b,g,r)
En12:  end
En13:  End
```

END OF TABLE 1

Figure 7:
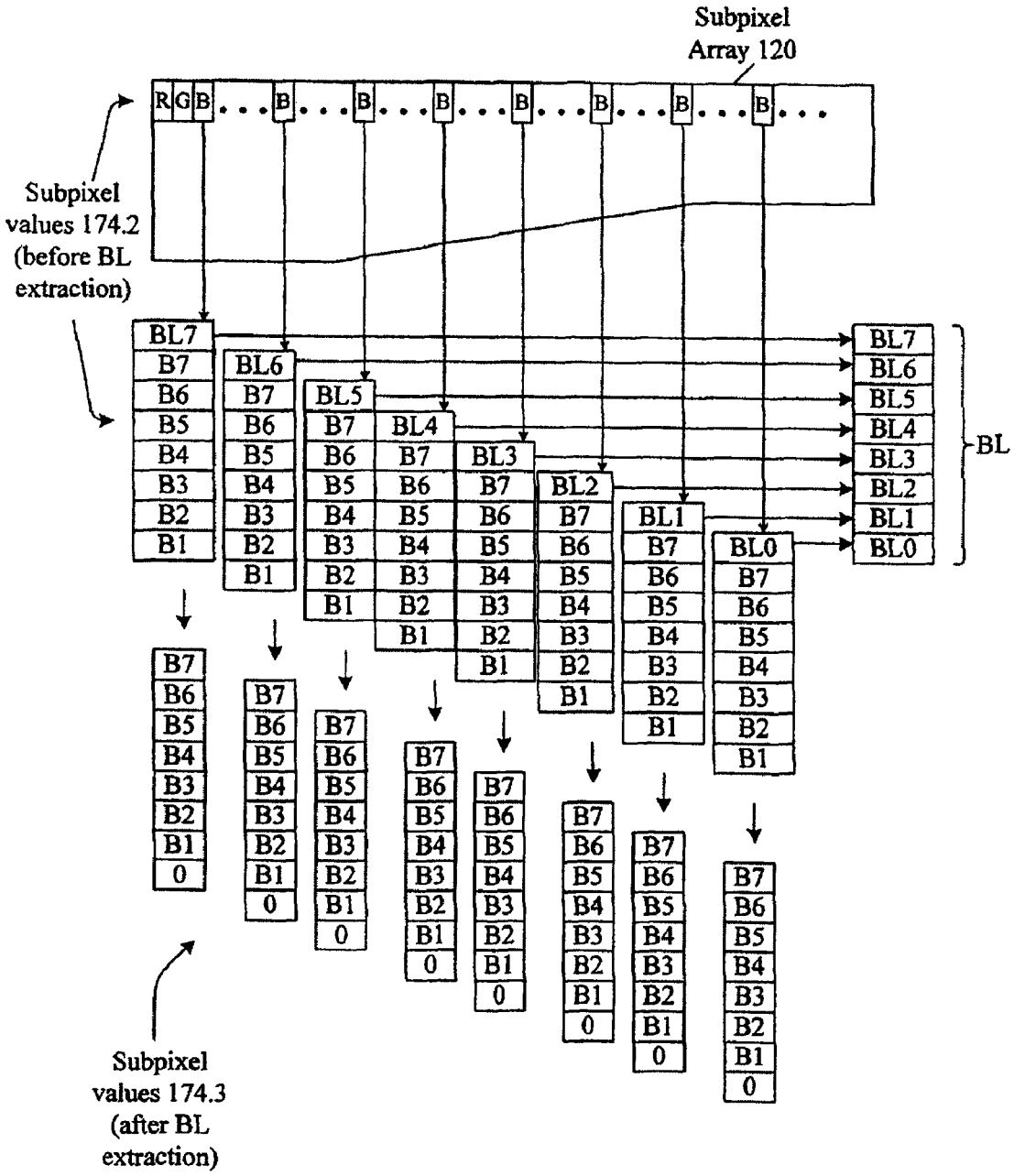
FIG. 7 illustrates data transformations performed by an image processing circuit in some embodiments of the present invention.

FIG. 7 illustrates operation of one embodiment of BL extraction circuit 530. Table 2 below illustrates Verilog code for one embodiment. In FIG. 7, the subpixel values for the first eight blue subpixels are shown at 174.2 before the BL extraction (as in FIG. 6), and at 174.3 after the extraction. The most significant bits of the blue-subpixel values 174.2 are extracted to form the BL signal BL7-BL0. See lines DE38-DE58 in Table 2. In each 8-bit subpixel value 174.2, the seven LSBs are shifted up to the most significant bit positions. The least significant bit of each blue-subpixel value is set to zero. See lines DE29-DE33 in Table 2.

In Table 2, the signal names with the suffix "_i" indicate input signals. See e.g. "reset_i". The signals "reset_i" (reset), "vsync_i" (vertical synch, i.e. the start of a frame) are active low. The signal "valid_i" indicates a valid subpixel value at the input of BL extraction circuit 530, and is active high. The same signals can e used at the interface between development system 210 and image processing circuit 170.

TABLE 2

DECODING

```
De1:   module embedded_pwm (
De2:           reset_i,
De3:           clk_i ,
De4:           vsync_i,
De5:           valid_i,
De6:           b_i ,
De7:           b_i_shft,
De8:           em_pwm
De9:   );
De10:
De11:  input reset_i;
De12:  input clk_i;
De13:  input vsync_i;
De14:  input valid_i;
De15:  input [7:0] b_i;
De16:  output [7:0] b_i_shft;
De17:  output [7:0] em_pwm;
De18:
De19:  reg [3:0] pixcnt ; //count first pixels
De20:  always @(posedge clk_i or negedge reset_i) begin
De21:          if (!reset_i || !vsync_i)
De22:            pixcnt <= 4'd0;
De23:          else if (valid_i && pixcnt<8)
De24:              pixcnt <= pixcnt+1;
De25:  end
De26:
De27:  reg [7:0] b_i_shft ; //blue data shifted for first 8 pixels
De28:  always @(posedge clk_i or negedge reset_i) begin
De29:          if (!reset_i)
De30:            b_i_shft <= 8'd0;
De31:          else if (valid_i && pixcnt<8)
De32:              b_i_shft <= {b_i[6:0],1'b0};
De33:          else
De34:              b_i_shft <= b_i;
De35:  end
De36:
De37:  reg [7:0] getpwm ; //sample pwm
De38:  always @(posedge clk_i or negedge reset_i) begin
De39:          if (!reset_i)
De40:            getpwm <= 8'd0;
De41:          else if (valid_i) begin
De42:            if (pixcnt==0)
De43:              getpwm[7] <= b_i[7];
De44:          else if (pixcnt==1)
De45:              getpwm[6] <= b_i[7];
De46:          else if (pixcnt==2)
De47:              getpwm[5] <= b_i[7];
De48:          else if (pixcnt==3)
De49:              getpwm[4] <= b_i[7];
De50:          else if (pixcnt==4)
De51:              getpwm[3] <= b_i[7];
De52:          else if (pixcnt==5)
De53:              getpwm[2] <= b_i[7];
De54:            else if (pixcnt==6)
De55:                getpwm[1] <= b_i[7];
De56:            else if (pixcnt==7)
De57:                getpwm[0] <= b_i[7];
De58:          end
De59:    end
De60:    reg [7:0] em_pwm ; //update pwm at vsync_i
De61:    always @(posedge clk_i or negedge reset_i) begin
De62:            if (!reset_i)
De63:              em_pwm <= 8'd0;
De64:            else if (!vsync_i)
De65:              em_pwm <= getpwm;
De66:    end
De67:  endmodule
```

END OF TABLE 2

The invention is not limited to the embodiments described above. Some embodiments provide a method for generating a display signal (e.g. signal 174.2 (FIG. 6) generated by development system 210 at step 410) for a display unit comprising a plurality of subpixels and also comprising a light source (e.g. backlight unit 140) for providing light in displaying an image, the display signal being a digital signal specifying subpixel values which define subpixel states in displaying the image and also specifying one or more light source control values (e.g. the BL value) for controlling a light output of the light source in displaying the image. There can be more than one BL value. For example, backlight unit 140 may have multiple independently controlled light source blocks, and a separate BL value can be provided for each block based on the image portion to be displayed in front of the block.

The method comprises: (1) obtaining a subpixel signal (e.g. 174.1 in FIG. 6) which is a digital signal comprising the subpixel values; (2) obtaining a light source signal (e.g. BL) which is a digital signal specifying the one or more light source control values; and (3) encoding at least part of the light source signal into one or more data positions (e.g. MSB positions) occupied, in the subpixel signal (e.g. in 174.1), by at least part of one or more subpixel values to obtain the display signal. Of note, with regard to FIG. 6, the BL value can be encoded into data positions other than the MSB positions. Also, the BL value can be encoded into two or more bits of the subpixel values. For example, bits B7, B6 can be chosen for the BL value, and the BL value can be encoded into four subpixel values.

In FIG. 6, "encoding" of the BL value involves moving bits of the BL value into the MSB positions. However, other types of encoding are possible. For example, some mathematical operation can be used to combine the BL bits with the subpixel values. The invention is not limited to any particular method of encoding.

In some embodiments, in operation (3), i.e. in the encoding operation, each of the one or more subpixel values is a subpixel value of a subpixel at an edge of the image. This can be the top edge as in FIG. 6, or a bottom edge, or some other edge. In FIG. 6, the image occupies the whole subpixel array 120, but the image can occupy only part of subpixel array 120. In this case, in some embodiments, the BL value is encoded into subpixels at the edge of the image even if these subpixels are not at the edge of the subpixel array 120.

In some embodiments, in operation (3), each of the one or more subpixel values is a subpixel value of a subpixel of a predefined primary color (e.g. blue) at an edge of a display area comprising all the subpixels of the predefined primary color in the image. In FIG. 6, the display area comprising all the blue subpixels is essentially the area of the whole subpixel array 120. In other embodiments, the area occupied by the blue subpixels can be smaller. For example, the blue subpixels may be absent from the top pixel row of the display. Also, the predefined primary color does not have to be blue. See e.g. the following publications incorporated herein by reference: the aforementioned PCT application WO 2006/127555 A2; U.S. patent application published as no. 2003/0034992 A1 on Feb. 20, 2003, filed by Brown Elliott et al., entitled "CONVERSION OF A SUB-PIXEL FORMAT DATA TO ANOTHER SUB-PIXEL DATA"; U.S. patent application published as no. 2005/0104908 A1 on May 19, 2005, filed by Brown Elliott, entitled "COLOR DISPLAY PIXEL ARRANGEMENTS AND ADDRESSING MEANS"; and U.S. patent application published as no. 2005/0225574 A1 on Oct. 13, 2005, filed by Brown Elliott et al., entitled "NOVEL SUBPIXEL LAYOUTS AND ARRANGEMENTS FOR HIGH BRIGHTNESS DISPLAYS".

In some embodiments, in operation (3), each of the one or more subpixel values is a subpixel value of a subpixel at an edge of an area comprising all the subpixels of the display unit.

In some embodiments, in operation (3), each of the one or more subpixel values is a subpixel value of a subpixel of a predefined primary color at an edge of an area comprising all the subpixels of the predefined primary color of the display unit.

In some embodiments, in operation (3), at least said part of the light source signal is encoded into most significant bit positions of the one or more subpixel values (see e.g. FIG. 6), each of the one or more subpixel values comprising one or more most significant bits moved from the one or more most significant bit positions of the subpixel value into one or more less significant bit positions of the subpixel value to obtain the digital signal. For example, in FIG. 6, each subpixel value shown has the MSB B7 moved from the most significant bit position 7 in subpixel values 174.1 to the bit position 6 in subpixel values 174.2. In other embodiments, B7 can be moved to position 0 or some other position. Moving the bits as in FIG. 6 (i.e. moving each bit Bi to position i−1) is desirable because this is robust against truncation in the sense that truncation of least significant bits would affect only the least significant bits of the subpixel values. However, the embodiment of FIG. 6 is not limiting.

Some embodiments provide a method for decoding a display signal (e.g. 174.2 in FIG. 7) for a display unit comprising a plurality of subpixels and also comprising a light source for providing light in displaying an image, the display signal being a digital signal specifying subpixel values which define subpixel states in displaying the image and also specifying one or more light source control values for controlling a light output of the light source in displaying the image, the subpixel values being specified in at least first data positions in the display signal, at least part of the one or more light source control values being specified in at least one or more second data positions in the display signal (in FIG. 7, the second data positions are the positions of bits BL7-BL0 in subpixel values 174.2). The first data positions either overlap or do not overlap with the one or more second data positions. In particular, as stated above, the BL values can be combined with the subpixel values in some way such that the same bit position may include information on both the subpixel values and the BL value. The method comprises: (1) obtaining a light source signal which is a digital signal specifying the one or more light source control values, wherein at least part of the light source signal is obtained from the one or more second data positions of the display signal; and (2) obtaining a subpixel signal from the display signal, the subpixel signal being a digital signal comprising the subpixel values, wherein the one or more second data positions of the subpixel signal comprise at least part of the subpixel values (for example, in the subpixel signal 174.3, the second data positions (the positions occupied by the BL value in signal 174.2) are occupied by bits of subpixel values).

In some embodiments, all of the first and second data positions of the subpixel signal are used to specify the subpixel values. For example, in signal 174.3, all the positions are used to specify the subpixel values. This includes the positions used for the BL value in signal 174.2.

In some embodiments, in operation (2), each of the one or more second data positions is in a subpixel value of a subpixel at an edge of the image.

In some embodiments, in operation (2), each of the one or more second data positions is in a subpixel value of a subpixel of a predefined primary color at an edge of an area comprising all the subpixels of the predefined primary color in the image.

In some embodiments, the predefined primary color is blue.

In some embodiments, in operation (2), each of the one or more second data positions is in a subpixel value of a subpixel at an edge of an area comprising all the subpixels of the display unit.

In some embodiments, in operation (2), each of the one or more second data positions is in a subpixel value of a subpixel of a predefined primary color at an edge of an area comprising all the subpixels of the predefined primary color of the display unit.

In some embodiments, in the subpixel signal, the one or more second data positions are most significant bit positions of one or more subpixel values.

Some embodiments provide an image processing method comprising generating a subpixel signal and a light source signal (e.g. as in FIG. 5) for a display unit comprising a plurality of subpixels, the display unit also comprising a light source for providing light in displaying an image, the subpixel signal being a digital signal specifying subpixel values which define subpixel states in displaying the image, the light source signal being for controlling a light output of the light source in displaying the image, the method comprising: in normal mode, generating the subpixel signal and the light source signal from an image signal (e.g. 164) which is a digital signal defining the image; (B) in bypass mode, generating the subpixel signal and the light source signal from a display signal (e.g. 174.2) which is a digital signal specifying the subpixel values and also specifying one or more light source control values which are for defining the light source signal, wherein in the display signal, the subpixel values are specified in at least first data positions, at least part of the one or more light source control values being specified in at least one or more second data positions in the display signal, wherein the first data positions either overlap or do not overlap with the one or more second data positions.

Some embodiments provide an image processing circuit comprising circuitry for operating in normal mode and, alternatively, in bypass mode, the circuitry being for providing a subpixel signal and a light source signal to a display unit comprising a plurality of subpixels and also comprising a light source for providing light in displaying an image, the subpixel signal being a digital signal comprising subpixel values which define subpixel states in displaying the image, the light source signal specifying a light output of the light source in displaying the image, the circuitry being for: (A) in the normal mode, generating the subpixel signal and the light source signal from an image signal (e.g. 164) which is a digital signal defining the image; (B) in the bypass mode, generating the subpixel signal and the light source signal from a display signal which is a digital signal specifying the subpixel values and also specifying one or more light source control values which are for defining the light source signal, wherein in the display signal, the subpixel values are specified in at least first data positions, at least part of the one or more light source control values being specified in at least one or more second data positions in the display signal, wherein the first data positions either overlap or do not overlap with the one or more second data positions.

In some embodiments, in operation (A), the image signal specifies the image in color coordinates independent of the light output of the light source. For example, the image data 164 can specify RGB coordinates independent of the light source. In contrast, the subpixel values 174 can be adjusted to correspond to the BL value so that if backlight unit 140 is dimmed, then the subpixels are made more transmissive. Thus, the subpixel values 174 depend on the light output of the light source.

In some embodiments, all of the first and second data positions of the subpixel signal are used to specify the subpixel values.

In some embodiments, the image processing circuit comprises: a first circuit (e.g. 520) for performing operation (A) at least in the normal mode; a second circuit (e.g. 530) for performing operation (B) at least in the bypass mode; and a circuit (e.g. multiplexers 540, 550) for selecting the subpixel signal and the light source signal from the first circuit in the normal mode and from the second circuit in the bypass mode.

In some embodiments, in operation (B), each of the one or more second data positions is in a subpixel value of a subpixel at an edge of the image.

In some embodiments, in operation (B), each of the one or more second data positions is in a subpixel value of a subpixel of a predefined primary color at an edge of an area comprising all the subpixels of the predefined primary color in the image.

In some embodiments, in operation (B), each of the one or more second data positions is in a subpixel value of a subpixel at an edge of an area comprising all the subpixels of the display unit.

In some embodiments, in operation (B), each of the one or more second data positions is in a subpixel value of a subpixel of a predefined primary color at an edge of an area comprising all the subpixels of the predefined primary color of the display unit.

In some embodiments, in the subpixel signal, the one or more second data positions are most significant bit positions of one or more subpixel values.

Other embodiments and variations are within the spirit and scope of the present disclosure of invention, which includes the originally appended claims.

The invention claimed is:

1. A method for generating a display driving signal for driving a display unit comprising a display panel having a plurality of subpixels and also comprising a light source configured for providing light to the subpixels for thereby forming an image, the generated display driving signal being a composite digital signal specifying subpixel values which define subpixel states for corresponding ones of the subpixels for thereby defining a to-be-formed image and the composite digital signal also specifying one or more light source control values for controlling a light output of the light source for thereby further defining the to-be-formed image, the method comprising:

(1) obtaining a subpixel signal which is a first digital signal representing subpixel values;

(2) obtaining a light source signal which is a second digital signal representing one or more light source control values; and (3) encoding at least part of the light source signal into the to-be-generated display driving signal such that the encoded at least part of the light source signal occupies one or more data positions in the to-be-generated display driving signal that otherwise would have been occupied by at least part of the obtained subpixel signal, thus forming the composite digital signal.

2. The method of claim 1 wherein in operation (3), each of the one or more subpixel values that has its data positions within the composite digital signal instead occupied by the encoded at least part of the light source signal, is a subpixel value of a subpixel at an edge of the to-be-formed image.

3. The method of claim 1 wherein in operation (3), each of the one or more subpixel values that has its data positions within the composite digital signal instead occupied by the encoded at least part of the light source signal, is a subpixel value of only subpixels of a predefined primary color that are located at an edge of a display area, where the edge also includes subpixels of colors other than the predefined primary color.

4. The method of claim 3 wherein the predefined primary color is blue.

5. The method of claim 1 wherein in operation (3), the one or more data positions that are occupied by the encoded at least said part of the light source signal are most significant bit positions of the respective one or more subpixel values that have such occupied data positions, and wherein each of the one or more occupied subpixel values has one or more of its most significant bits respectively moved to data positions of respective lesser significance.

6. A method for decoding a display signal for a display unit comprising a plurality of subpixels and also comprising a light source for providing light in displaying an image, the display signal being a digital signal specifying subpixel values which define subpixel states in displaying the image and also specifying one or more light source control values for controlling a light output of the light source in displaying the image, the subpixel values being specified in at least first data positions in the display signal, at least part of the one or more light source control values being specified in at least one or more second data positions in the display signal, wherein the first data positions either overlap or do not overlap with the one or more second data positions, the method comprising:

(1) obtaining a light source signal which is a digital signal specifying the one or more light source control values, wherein at least part of the light source signal is obtained from the one or more second data positions of the display signal; and (2) obtaining a subpixel signal from the display signal, the subpixel signal being a digital signal comprising the subpixel values, wherein the one or more second data positions of the subpixel signal comprise at least part of the subpixel values.

7. The method of claim 6 wherein all of the first and second data positions of the subpixel signal are used to specify the subpixel values.

8. The method of claim 6 wherein in operation (2), each of the one or more second data positions is in a subpixel value of a subpixel at an edge of the image.

9. The method of claim 6 wherein in operation (2), each of the one or more second data positions is in a subpixel value of a subpixel of a predefined primary color at an edge of an area comprising all the subpixels of the predefined primary color in the image.

10. The method of claim 6 wherein in operation (2), each of the one or more second data positions is in a subpixel value of a subpixel at an edge of an area comprising all the subpixels of the display unit.

11. The method of claim 6 wherein in operation (2), each of the one or more second data positions is in a subpixel value of a subpixel of a predefined primary color at an edge of an area comprising all the subpixels of the predefined primary color of the display unit.

12. The method of claim 6 wherein in the subpixel signal, the one or more second data positions are most significant bit positions of one or more subpixel values.

13. An image processing method comprising generating a subpixel signal and a light source signal for a display unit comprising a plurality of subpixels, the display unit also comprising a light source for providing light in displaying an image, the subpixel signal being a digital signal specifying subpixel values which define subpixel states in displaying the image, the light source signal being for controlling a light output of the light source in displaying the image, the method comprising:

(A) in normal mode, generating the subpixel signal and the light source signal from an image signal which is a digital signal defining the image;

(B) in bypass mode, generating the subpixel signal and the light source signal from a display signal which is a digital signal specifying the subpixel values and also specifying one or more light source control values which are for defining the light source signal, wherein in the display signal, the subpixel values are specified in at least first data positions, at least part of the one or more light source control values being specified in at least one or more second data positions in the display signal, wherein the first data positions either overlap or do not overlap with the one or more second data positions.

14. An image processing circuit comprising circuitry for operating in normal mode and, alternatively, in bypass mode, the circuitry being for providing a subpixel signal and a light source signal to a display unit comprising a plurality of subpixels and also comprising a light source for providing light in displaying an image, the subpixel signal being a digital signal comprising subpixel values which define subpixel states in displaying the image, the light source signal specifying a light output of the light source in displaying the image, the circuitry being for:

(A) in the normal mode, generating the subpixel signal and the light source signal from an image signal which is a digital signal defining the image;

(B) in the bypass mode, generating the subpixel signal and the light source signal from a display signal which is a digital signal specifying the subpixel values and also specifying one or more light source control values which are for defining the light source signal, wherein in the display signal, the subpixel values are specified in at least first data positions, at least part of the one or more light source control values being specified in at least one or more second data positions in the display signal, wherein the first data positions either overlap or do not overlap with the one or more second data positions.

15. The image processing circuit of claim 14 wherein in operation (A), the image signal specifies the image in color coordinates independent of the light output of the light source.

16. The image processing circuit of claim 14 wherein all of the first and second data positions of the subpixel signal are used to specify the subpixel values.

17. The image processing circuit of claim 14, the image processing circuit comprising:

a first circuit for performing operation (A) at least in the bypass mode;

a second circuit for performing operation (B) at least in the bypass mode; and a circuit for selecting the subpixel signal and the light source signal from the first circuit in the normal mode and from the second circuit in the bypass mode.

18. The image processing circuit of claim 14 in combination with the display unit.

19. The image processing circuit of claim 14 wherein in operation (B), each of the one or more second data positions is in a subpixel value of a subpixel at an edge of the image.

20. The image processing circuit of claim 14 wherein in operation (B), each of the one or more second data positions is in a subpixel value of a subpixel of a predefined primary color at an edge of an area comprising all the subpixels of the predefined primary color in the image.

21. The image processing circuit of claim 14 wherein in operation (B), each of the one or more second data positions is in a subpixel value of a subpixel at an edge of an area comprising all the subpixels of the display unit.

22. The image processing circuit of claim 14 wherein in operation (B), each of the one or more second data positions is in a subpixel value of a subpixel of a predefined primary color at an edge of an area comprising all the subpixels of the predefined primary color of the display unit.

23. The image processing circuit of claim 14 wherein in the subpixel signal, the one or more second data positions are most significant bit positions of one or more subpixel values.

* * * * *